United States Patent [19]

Martin et al.

[11] 4,300,845

[45] Nov. 17, 1981

[54] DOT MATRIX PRINT HEAD

[75] Inventors: Donald P. Martin, Wheeling; Robert C. Hoffman, Park Ridge; Richard H. Kruse, Deerfield, all of Ill.

[73] Assignee: Qwint Systems, Inc., Northbrook, Ill.

[21] Appl. No.: 38,923

[22] Filed: May 14, 1979

[51] Int. Cl.[3] ..... B41J 3/12

[52] U.S. Cl. ..... 400/124; 101/93.05

[58] Field of Search ..... 400/124; 101/93.05

[56] References Cited

U.S. PATENT DOCUMENTS

| | | | |
|---|---|---|---|
| 3,787,791 | 1/1974 | Borger et al. | 400/124 X |
| 3,820,643 | 6/1974 | Priebs et al. | 400/124 |
| 3,834,506 | 9/1974 | Priebs | 400/104 |
| 3,929,214 | 12/1975 | Hebert | 400/124 |
| 3,963,108 | 6/1976 | Steinhausser | 400/124 |
| 4,044,878 | 8/1977 | Kunath | 101/93.05 X |

*Primary Examiner*—Paul T. Sewell

*Attorney, Agent, or Firm*—Lockwood, Dewey, Alex & Cummings

[57] ABSTRACT

A dot matrix-type print head for forming a character-defining array of individual dots on a print-receiving surface includes a plurality of parallel-spaced print wires arranged in a vertical plane perpendicular to the print receiving surface. The print wires are individually actuated by respective actuator assemblies which each include a stationary portion consisting of an end plate, a bobbin, a solenoid winding, and a spring, and a movable portion consisting of a magnetic armature attached to the associated print wire. Upon energization of the solenoid winding the resulting magnetic flux displaces the magnetic armature and causes the print wire to impact the print-receiving surface. A frame comprising two parallel-spaced side plates maintains the stationary print head components in alignment, and progressive vertical displacement of the actuator assemblies within the plane of the print wires to align with respective print wires enables the actuator assemblies to be formed from identical components for manufacturing economy.

25 Claims, 14 Drawing Figures

40
77
76
53h
74
75
56g
73
72
55g
68
69
70
57g
52g
80
81a
81b
66
54g
6a.
6b.
6c.
58g
65
52f
63
53g
54f
41
42
60h
62g

FIG. 10
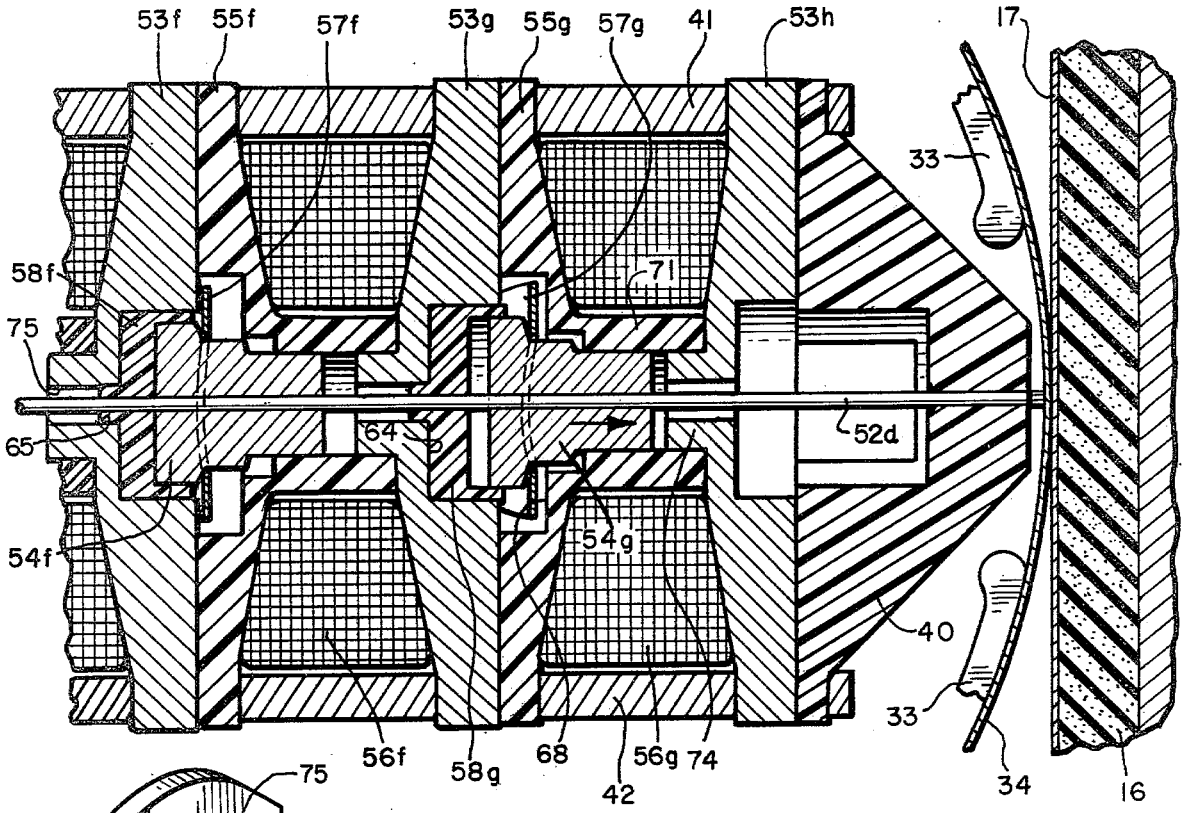
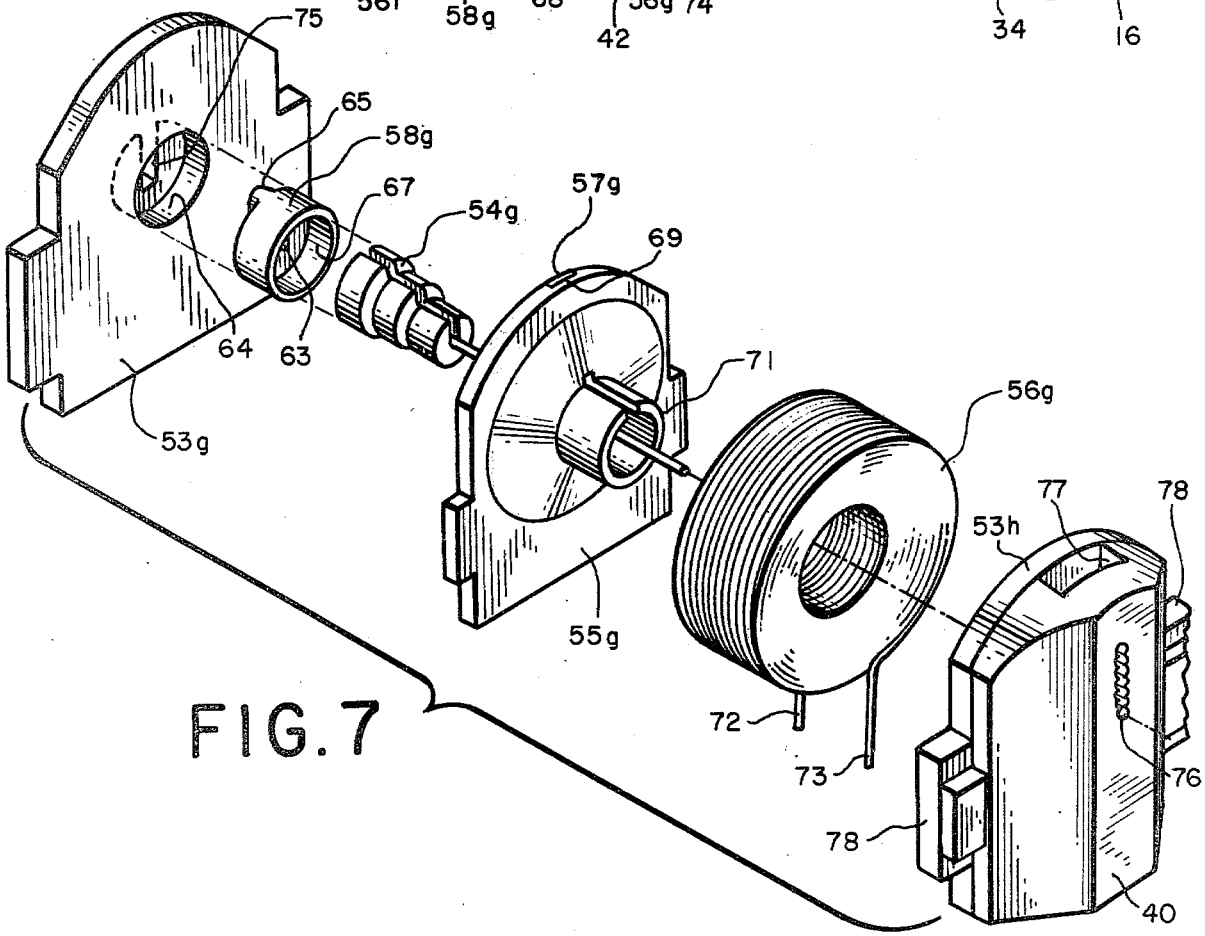
FIG. 7

DOT MATRIX PRINT HEAD

BACKGROUND OF THE INVENTION

The present invention is directed generally to print heads for data terminals, and more particularly to a high speed dot matrix-type print head of improved construction wherein the actuator elements of individual print elements are arranged in a colinear configuration.

In recent years the increased use of data-based communication systems has led to the need for economical high speed data terminals whereby information conveyed by electrical signals is converted to printed copy on paper or other print-retaining medium. Typically, such teleprinters incorporate an impact type print head, which impacts the paper against a platen as the head moves across the paper, causing impressions to be made on the paper by an inked ribbon or by chemical transformation of the paper. The print head may be either of the type-bar type, wherein the impressions are formed by a selected one of a font of individual characters, or of the matrix-type, wherein selected ones of a plurality of individual print elements are forced against the paper to form the desired characters as the print head is stepped across the page. A preferred construction for a matrix-type teleprinter is shown in the copending application of Robert C. Hoffman, Richard H. Kruse, and Donald P. Martin, entitled "Teleprinter", Ser. No. 038,942, filed concurrently herewith and assigned to the present assignee.

One particularly successful form of matrix printer is the dot matrix printer, wherein the printing operation is performed by a plurality of elongated rod-shaped printing wires arranged in an array with ends thereof adjacent to the printing surface. To print a given character, selected ones of the printing wires are driven into contact with the paper to print a matrix of dots which collectively form the character. The character imprint may be accomplished in a single operation if a multi-column matrix of printing wires is provided, or in several steps if a single-column matrix of printing wires is provided. In either type of dot matrix printer, the printing wires are actuated at high speed many times in printing each line of material, either once per character or several times per character.

Each of the print wires in a dot matrix printer is connected to an actuator assembly, which ordinarily includes an electromagnet for forcing one end of the print wire against the paper, and a spring member for returning the print wire to a non-impacting position. To provide space for the actuator assemblies, which are ordinarily much larger in diameter than the print wires, print heads have been constructed with the actuator assemblies spaced apart, either arcuately in a horizontal plane, or arcuately in a vertical plane. From these spaced actuator assemblies, the print wires have either been directed to the printing surface in a straight line, and therefore have impacted the paper at an angle, as shown in U.S. Pat. No. 3,729,079, or have been guided by appropriate curved tubes or sheaths so as to impact the paper perpendicularly to the printing surface.

Where the print wires are directed in a straight line so as to contact the paper at an angle, a less-than-optimum impression is formed on the paper, and the print wire and actuator must be carefully adjusted to avoid objectionable deterioration of the printed character. Where the print wires are guided by a tube or sheath, friction between the wires and the sheath has tended to slow down the response time of the wires, making the print head unreliable in high speed applications. Furthermore, as a result of dirt, grease, moisture or other foreign matter collecting in the sheath, there has been a tendency for the print wires to stick, particularly when the teleprinter is operated in a sub-freezing or otherwise adverse environment, making the printer unreliable and adding to maintenance expense.

Another problem encountered in dot matrix-type print heads results from the extremely rapid actuation required of the print wires at high print rates, particularly in those print heads which utilize a single vertical column of print wires wherein individual print wires must be actuated several times to reproduce a single character. Where long printing wires are used, such as in the spaced-array type heads, the mechanical inertia of the long wires tends to limit maximum printing speed. For this reason, it is desirable that the print wire actuator assemblies be positioned as close to the printing surface as possible to minimize the length of the print wires.

A further disadvantage of spaced-apart print-wire actuator assemblies is that the print head requires a comparatively large volume, thereby complicating the design and construction of the carriage required to transport the print head across the paper.

One form of print head construction which obviates the above deficiencies is a colinear arrangement wherein the print elements are arranged side-by-side in close parallel-spaced relationship, with individual electromagnetic actuators thereof arranged coaxial to the print wires, one behind the other. Examples of such colinear print heads are shown in U.S. Pat. Nos. 3,963,108, 3,834,506 and 3,820,643. Unfortunately, such colinear print heads have heretofore been unnecessarily bulky and complex in construction, making them undesirably slow and expensive for use in teleprinters. The present invention provides a colinear-type print head of improved construction, wherein closely spaced print wires are provided in conjunction with individual actuator assemblies constructed of identical components adapted for mounting in a compact self-aligning frame assembly.

Accordingly, it is a general object of the present invention to provide a new and improved print head for use in a teleprinter or the like.

It is a more specific object of the present invention to form a new and improved print head which is simpler in construction and more reliable in operation.

It is another specific object of the present invention to provide a new and improved colinear-type print head wherein the print wire actuators are formed of identical components for improved manufacturing economy.

SUMMARY OF THE INVENTION

The invention is directed to a print head of the type selectively printing on a print-receiving surface a matrix of dots within a predetermined character-forming array. The print head includes a plurality of parallel-spaced print elements aligned with respective positions in the matrix, one end of each of the print elements being positioned adjacent the print-receiving surface. Restoration means are provided for biasing the elements to retract positions clear of the print-receiving medium. A plurality of magnetically conductive end plates are arranged in parallel-spaced relationship substantially one behind the other, each of the plates including an aperture for receiving at least a portion of the print elements therethrough, and actuator means including a plurality of solenoid windings disposed between respective adjacent pairs of end plates are included for selectively producing a magnetic field between respective ones of the adjacent pairs of end plates. Means including a plurality of magnetic armatures mechanically coupled to respective ones of the print elements between respective pairs of the end plates and responsive to the magnetic field therebetween, are provided for driving the print elements into impact with the print-receiving surface upon actuation of the respective one of the solenoid windings.

BRIEF DESCRIPTION OF THE DRAWINGS

The features of the present invention which are believed to be novel are set forth with particularity in the appended claims. The invention, together with the further objects and advantages thereof, may best be understood by reference to the following description taken in conjunction with the accompanying drawings, in the several figures of which like reference numerals identify like elements, and in which:

FIG. 7 is an exploded perspective view of the front print wire actuator assembly of the print head showing the arrangement of the individual components therein.

FIG. 10 is an enlarged cross-sectional view taken along line 10—10 of FIG. 9 useful in illustrating the operation of the print head.

DESCRIPTION OF THE PREFERRED EMBODIMENT

Figure 1:
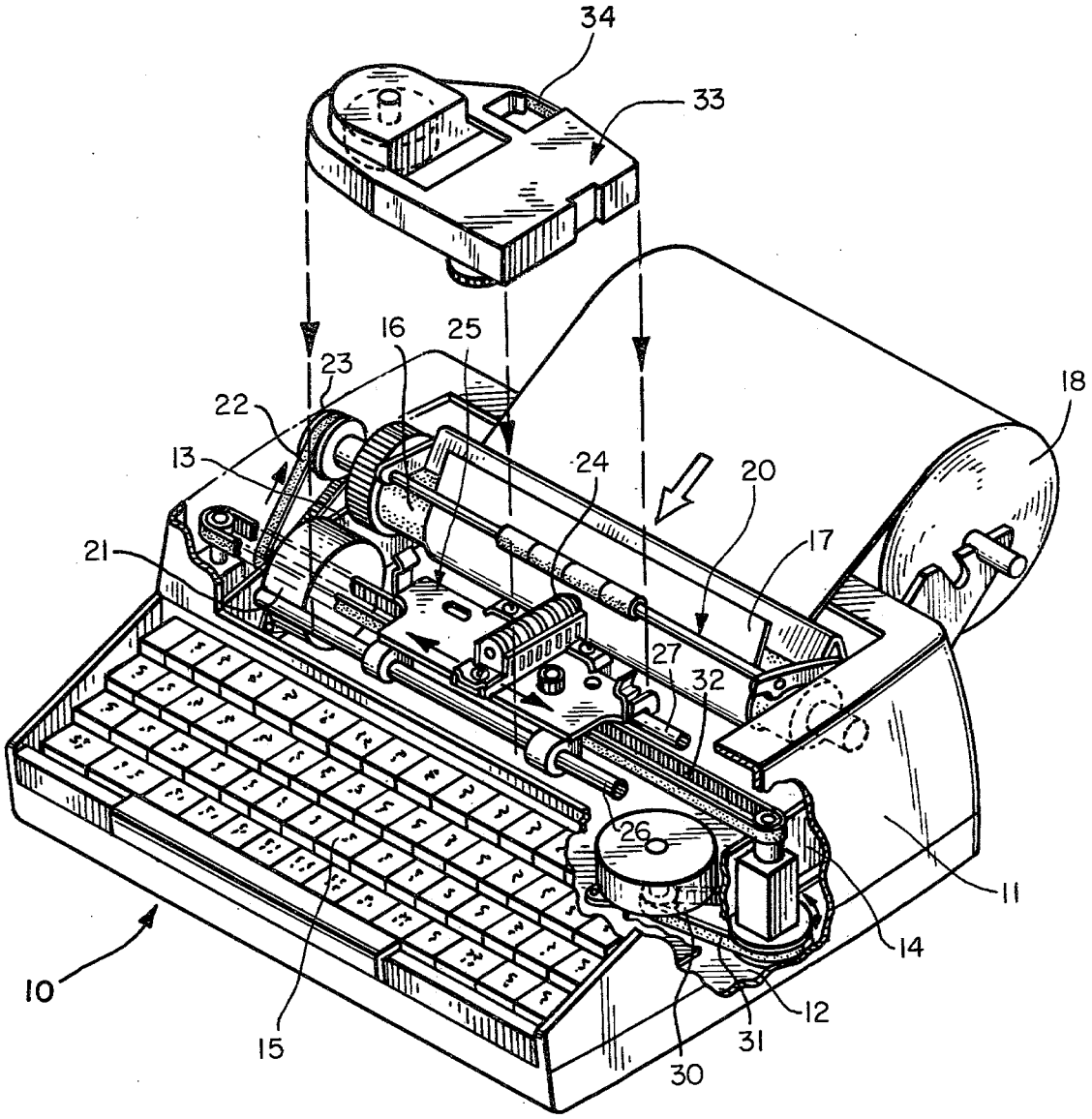
FIG. 1 is a perspective view of a high speed teleprinter incorporating a print head constructed in accordance with a preferred embodiment of the invention.

Referring to the figures, and particularly of FIG. 1, a print head constructed in accordance with the invention is incorporated in a high speed teleprinter 10 of the type commonly utilized for converting applied electrical signals to printed text. The teleprinter is seen to include a housing 11 within which a frame comprising a base plate 12 and side plates 13 and 14 is contained. A keyboard 15 of conventional construction is incorporated into the front portion of the housing, and a platen 16 extending across the rear portion between side plates 13 and 14 serves to position a sheet of paper 17, either in web form from a roll 18, as shown, or in folded form, in position for printing.

A paper hold-down roller assembly 20 is provided to hold paper 17 in position against platen 16. To advance paper 17 platen 16 is rotatably driven by a stepper motor 21 mounted on side plate 13 and rotatably coupled to the platen by means of a cogged drive belt 22 and a pulley 23.

Visible characters are produced on paper 17 by print head 24. The print head is positioned for printing by a print head carriage assembly 25, which is adapted for lateral movement across the page by means of two parallel-spaced guide rods 26 and 27 which extend between side plates 3 and 14. The carriage is moved by a second stepper motor 30, which is mounted on base plate 12 and coupled to carriage 25 by means of cogged drive belts 31 and 32. Carriage 25 is coupled to drive belt 32 along the rear (as viewed in FIG. 1) span thereof, so that as the belt is driven by motor 30 the carriage is advanced along the line. A removable ink ribbon cartridge 33 carried on the print head carriage includes an inked ribbon 34 which is positioned between the print elements of print head 24 and page 17 to render each impact of the print head visible on the paper.

The print head carriage 25 and its associated drive system are described in detail in the previously identified co-pending application, and reference is made to that application for a fuller description of the construction and operation of this assembly.

Figure 2:
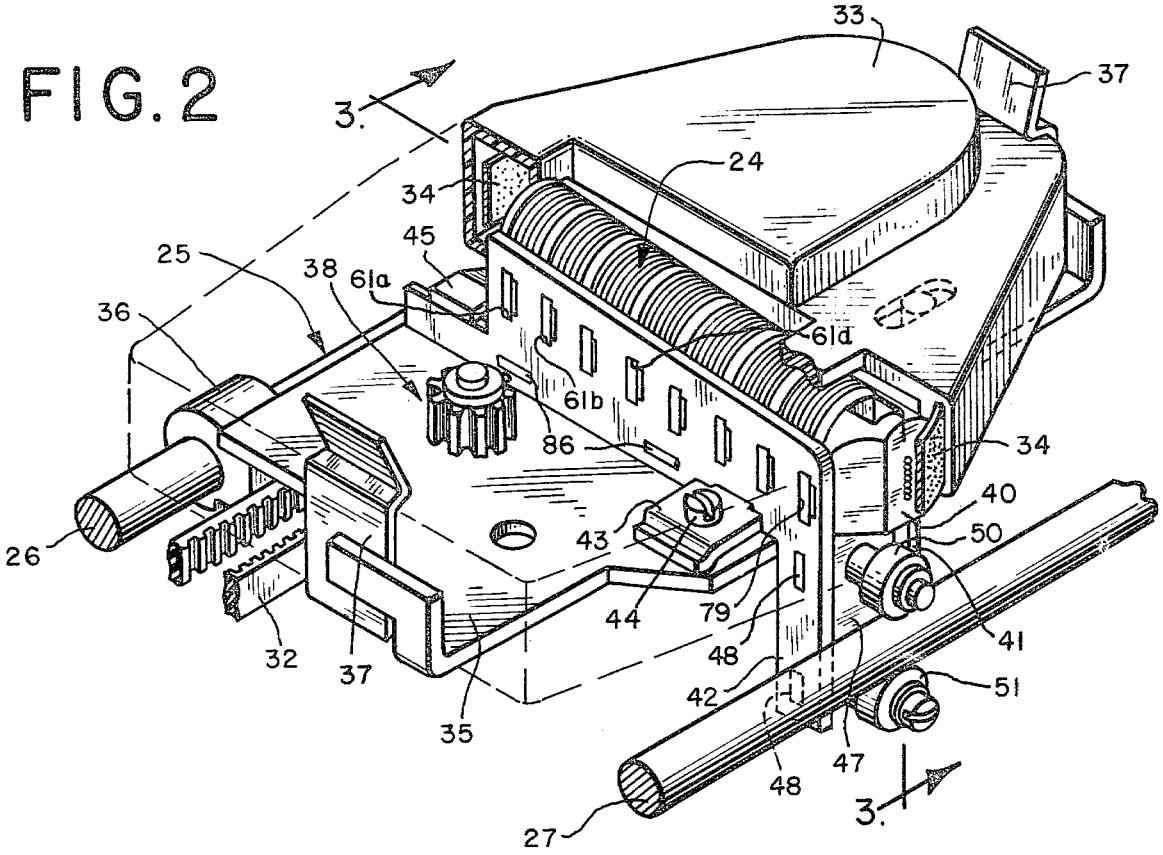
FIG. 2 is an enlarged perspective view of the teleprinter print head carriage partially broken away to illustrate the mounting of the print head thereon.

Referring to FIG. 2, the print head carriage 25 is seen to include a base plate 35 slidably mounted on guide bar 26 by means of a pair of bearings 36. The ink ribbon cartridge 33 is secured to base plate 35 by means of spring clips 37 located at either end of the base plate. A ribbon drive gear 38 on the top surface of base plate 35 is rotatably driven during forward motion of the print head carriage to advance ribbon 34 within cartridge 33.

Print head 24 is seen in FIG. 2 to include at its forward or printing end a matrix-defining guide block 40 disposed between a frame consisting of two parallel-spaced L-shaped flat side plates 41 and 42. The side plates are fastened at their front ends to base plate 35 by means of a pair of clamps 43 which include projecting tab portions extending into appropriately dimensioned slots in the side plates. The clamp members are in turn secured to base plate 35 by means of conventional machine screws 44. The rear ends of the side plates are secured to base plate 35 by means of a clamp 45, which is secured to the base plate by a machine screw 46 (FIG. 3).

To provide support for the front end of carriage 25 and for print head 24, a transverse plate 47 is arranged in a vertical plane perpendicular to the axis of the print head between the downwardly projecting portions of side plate members 41 and 42. This member is held in position by outwardly projecting tab portions which engage complimentarily dimensioned slots 48 in the side plates. A pair of guide rollers 50 and 51 are rotatably mounted to cross member 47 and are spaced so as to engage the top and bottom surfaces of guide rod 27. In this way, positive vertical positioning of the carriage and print head with respect to guide rod 27 is obtained.

Figure 3:
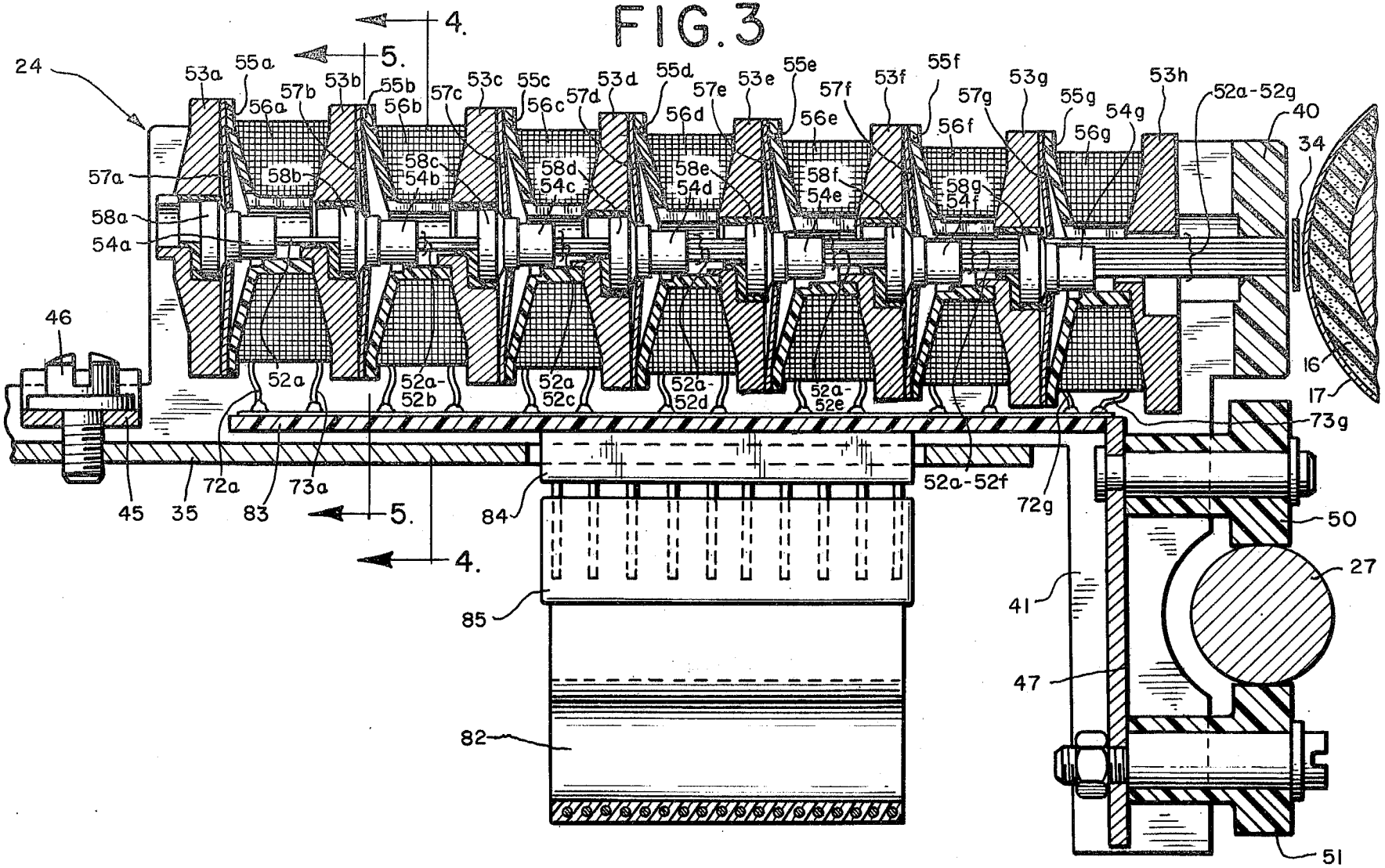
FIG. 3 is an enlarged cross-sectional view of the print head taken along line 3—3 of FIG. 2.

Referring to FIG. 3, print head 24 is seen to include seven print elements in the form of straight parallel-spaced rod-like print wires 52*a*–52*g* arranged one above the other in a vertical plane. The impact or working ends of the print wires are received within respective guide apertures in guide block 40. Upon axial displacement of the print wires (to the right in FIG. 3) the impact ends of the wires impact the paper against platen 16, causing the intervening ink ribbon 34 to produce a visible mark or dot on the paper.

Figure 5:
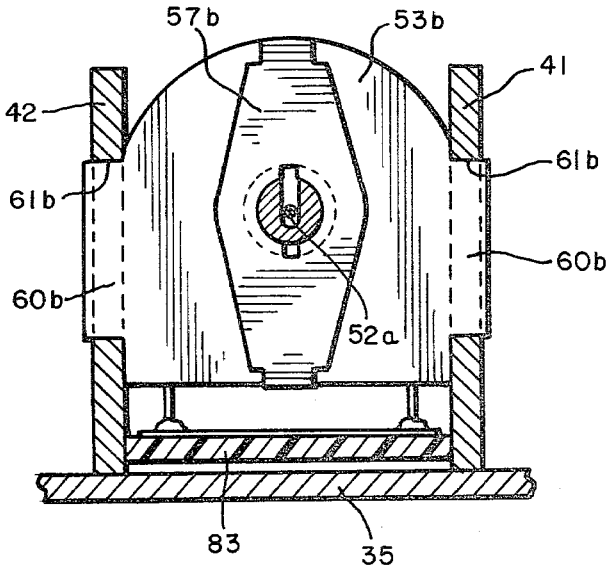
FIG. 5 is a cross-sectional view of the print head taken along line 5—5 of FIG. 3.
Figure 4:
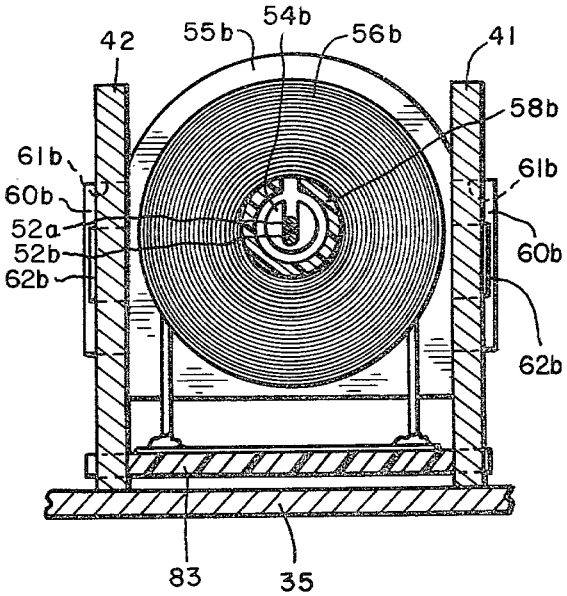
FIG. 4 is a cross-sectional view of the print head taken along line 4—4 of FIG. 3.

To provide for axial displacement of the respective print wires 52*a*–52*g* in response to an electrical signal, each print wire has associated with it an individual actuator assembly comprising a stationary metallic end plate 53, a magnetic armature 54, a non-metallic bobbin 55, an electrical solenoid winding 56, a flat spring element 57, and a non-magnetic cup-shaped guide element 58. The components 53–58 of the actuator assemblies are identical for all seven print wires, and are arranged substantially one behind the other. As best shown in FIGS. 4 and 5, the stationary end plates 53*a*–53*h* of the print head are held in vertical parallel-spaced alignment by means of oppositely projecting tab portions 60 which engage complimentarily dimensioned solts 61 on side plates 41 and 42. Similarly, bobbins 55*a*–55*g* are held in place by projecting tab portions 62 which engaged portions of the same slots. Since the other elements of the actuator assemblies are mounted to the end plates and bobbins, alignment of these elements results in positive alignment of the entire actuator assemblies. After assembly, a layer of epoxy or other suitable bonding material (not shown) may be placed between the side plates and over the external surfaces of the end plates, bobbins and solenoid windings of the actuator assemblies to permanently maintain alignment and protect against inadvertent damage.

Figures 6, 6A, 6B, 6C, 8:
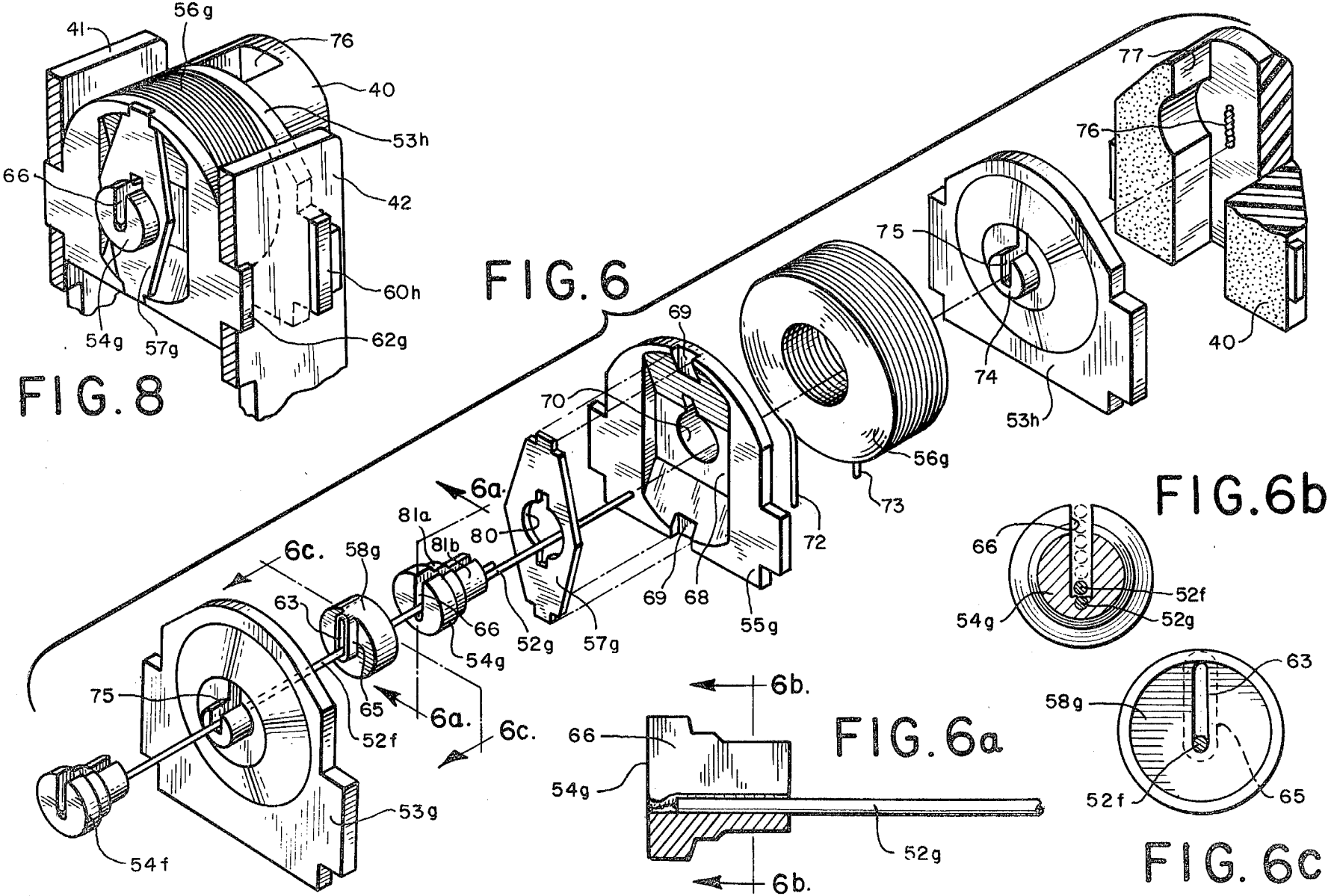
FIG. 6 is an exploded perspective view of a portion of the print head illustrating the arrangement of the individual components therein.
FIG. 6*a* is an enlarged cross-sectional view of the magnetic plunger of the print head taken along line 6*a*—6*a* of FIG. 6 illustrating the attachment of the associated print wire to the plunger.
FIG. 6*b* is an enlarged cross-sectional view of the magnetic plunger of the print head taken along line 6*b*—6*b* of FIG. 6*a* showing the attachment.
FIG. 6*c* is an enlarged end elevational view of the print wire guide member of the print head taken along line 6*c*—6*c* of FIG. 6.
FIG. 8 is an enlarged perspective view of an actuator assembly for one print element showing the mounting thereof to the print head frame members.

The construction of the actuator assemblies is illustrated in FIGS. 6–8. In particular, the actuator assembly for the bottom print wire 52*g*, which is representative of the seven actuator assemblies of the print head, is seen to comprise an end plate 53*g*, a plastic guide element 58*g*, a magnetic plunger 54*g*, a restoring spring 57*g*, a bobbin 55*g* and a solenoid winding 56*g*. The plastic guide element 58*g*, which is generally cup-shaped, includes at its closed end a vertical slot-like aperture 63 through which print wires 52*a*–52*f* extend to respective more rearwardly positioned actuator assemblies. The guide element is received within a recess 64 provided on the front face (FIG. 7) of the end plate. To provide for positive alignment with respect to end plate 53*g*, guide element 58*g* includes a rearwardly extending keyway portion 65 which is received in a slot-shaped recess 75 at the closed end of recess 64. Aperture 63 is dimensioned to receive up to seven print wires arranged one above the other in a vertical plane, and serves to maintain the print wires in this configuration. Where additional guidance for the print wires is desired, aperture 63 may be optionally provided with a plurality of scallops along its opposing side-walls to define parallel-spaced channels within which respective ones of the print wires are slidably received.

In the illustrated actuator assembly, as in all of the actuator assemblies, the bottom print wire terminates at its associated magnetic plunger, and the remaining print wires extend through the guide element and end plate to other more-rearward actuator assemblies. Although only one additional print wire 52*f* is shown extending through aperture 63 for the sake of clarity in FIG. 6, it will be understood that in practice a total of six print wires 52*a*–52*f* actually extend through aperture 63 in guide element 58*g*.

Referring to FIG. 6*a*, the magnetic armature 54*g* associated with the illustrated actuator assembly includes a slot-shaped channel 66 through which the seven print wires 52*a*–52*g* of the print head are received. The bottom print wire 52*g* is fixedly attached to the armature at the bottom of the channel by swaging or other appropriate means, and terminates just forward of the rear surface of the armature as shown to enable swaging behind the wire for improved mechanical rigidity. The second from the bottom print wire 52*f*, as well as the other print wires 52*a*–52*e* (not shown in FIG. 6), pass through the channel but are not attached to the armature. Thus, upon axial displacement of the armature, only the bottom print wire is displaced. To maintain the plunger in accurate alignment with the print wire, the cylindrical main body portion of the armature is slidably received in a bore-shaped recess 67 (FIG. 7) of complimentary dimensions on the front end of guide member 58*g*. The depth of recess 67 is sufficient to accommodate the armature in its non-actuated position, and upon actuation of the armature only a portion of the body extends beyond the recess so that alignment is maintained during the entire operating cycle of the print wire.

To provide for return of the print wires to a non-actuated position clear of the paper following actuation, a restoring force is exerted on armature 54*g* by restoring spring 57*g*. This spring includes a central aperture 80 through which a first forward reduced-diameter portion 81*a* of the armature is received so that the annular shoulder formed between the larger diameter main body of the armature and the reduced diameter portion bears against the spring. A recess 68 on the rear face of bobbin 55*g* provides clearance for the spring to flex forward upon actuation of the armature. A pair of notches 69 at either end of the recess receive complimentarily dimensioned tab portions at the ends of the spring to maintain the spring in alignment. A bore-shaped aperture 70 through bobbin 55*g* provides clearance for a second armature portion 81*b* of further reduced diameter during forward displacement of print wire 52*g*.

The front face of bobbin 55*g* includes a central generally cylindrical core portion 71 over which the annular solenoid winding 56*g* is received. A central cylindrical core portion 74 projecting from the rear surface of an additional end plate 53*h* functions as indexing means and in cooperation with core portion 71 maintains the solenoid winding in accurate alignment. A pair of electrical contacts 72 and 73 project downwardly from solenoid winding 56*g* to facilitate connection of the winding to an external source of excitation.

Figure 9A:
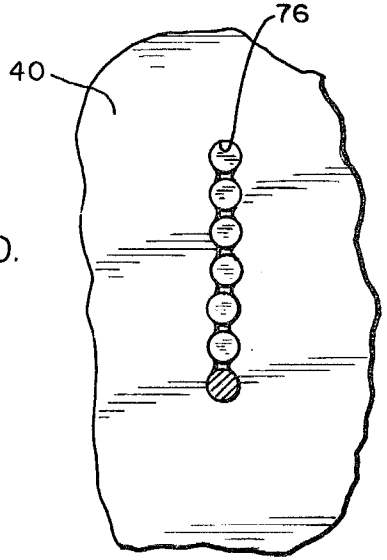
FIG. 9*a* is an enlarged front elevational view of the print head taken along line 9*a*—9*a* of FIG. 9 showing the matrix guide block and parallel-spaced print wires of the print head.
Figure 9:
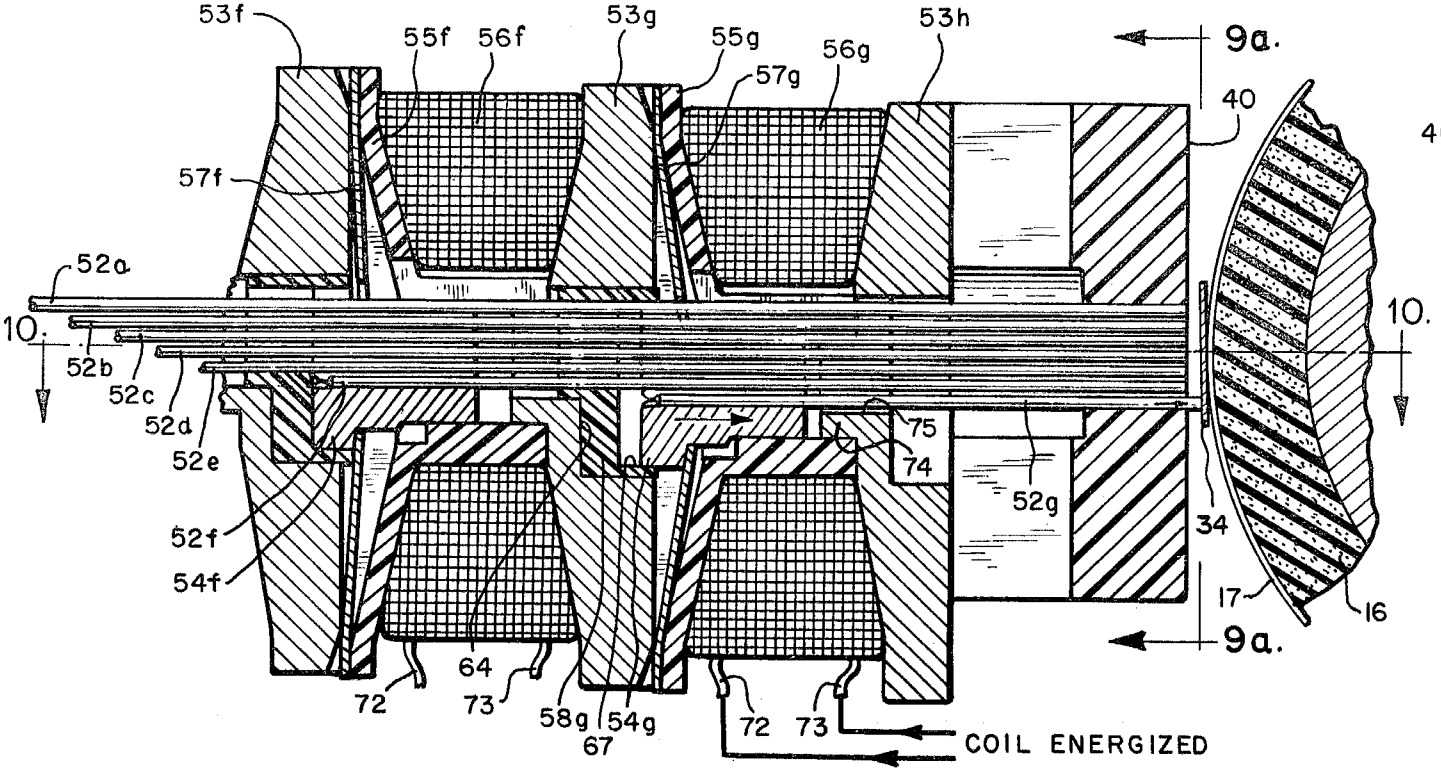
FIG. 9 is an enlarged cross-sectional view of the front portion of the print head.

Referring to FIG. 9, the additional end plate 53*h* provided between the forward end of solenoid winding 56*g* and guide block 40, like end plates 53*a*–53*g*, includes a slot-shaped aperture 75 through which the seven print wires 52*a*–52*g* pass. Guide block 40 includes a vertically-aligned slot-shaped aperture 76 having scalloped sidewalls which define individual channels for the seven print wires of the print head. By reason of the front face of the guide block being in close proximity to the paper, these channels define with a high degree of precision the individual matrix positions of the print wires. An aperture 77 in the top surface of guide block 40 facilitates access to the interior of the guide block for cleaning purposes. Oppositely projecting tab portions 78 extending from the guide block into complimentarily dimensioned apertures 79 (FIG. 2) in side plates 41 and 42 secure the guide block in position.

The operation of the seven print wire actuator assemblies of the print head is illustrated in FIGS. 9 and 10. Assuming it is desired to actuate the bottom print wire 52*g*, solenoid winding 56*g* is energized by application of an appropriate current to the terminals 72 and 73 of the winding. This causes a magnetic flux to be developed between the adjacent metallic end plates 53*g* and 53*h*, which function as magnetic pole pieces, causing the magnetic armature 54*g* to be displaced axially forward as magnetic poles of opposite gender are formed in the armature and it attempts to complete the magnetic circuit. To this end, the annular spacing between the cylindrical body portion of armature 54*g* and the sidewall of recess 64 is made relatively small and the spacing between the rear end of the armature and the back wall of recess 64 is made relatively large, thereby forming a magnetic circuit having a substantially perpendicular interface with armature 54*g* to preclude the armature from moving rearwardly in attempting to complete the magnetic circuit. Since print wire 52*g* is attached at its rear end to plunger 54*g*, the forward end of the print wire is forced against ink ribbon 34 and platen 16, resulting in a visible dot-shaped image being produced on paper 17. Spring member 57*g* is also displaced forward with movement of the armature, and upon interruption of current through solenoid winding 56*g* the spring member exerts sufficient force on the armature to return the print wire 52*g* to its non-actuated position.

The potential for interaction between adjacent actuator assemblies is minimized by end plates 53*a–h*, which provide a low reluctance path for the magnetic field generated by intervening solenoid windings to effectively shunt any leakage path existing to adjacent actuator assemblies.

It will be observed in FIG. 9 that the individual actuator assemblies, although basically in a colinear arrangement one behind the other, are actually slightly offset in a vertical direction progressing from the front to the rear of the print head. This is accomplished by an offset between the axis of the bore 64 on the front face and the axis of the cylindrical projection 74 on the rear face of each end plate 53. As a result of the offset, the bottom-most print wire for any particular actuator assembly is received at the bottom of the channel 66 of the magnetic armature 54 associated with that actuator assembly. This makes it possible to use identical end plates 53, magnetic armatures 54, bobbins 55, solenoid windings 56, spring members 57 and guide members 58 in each actuator assembly. Thus, the number of different components required in the print head and the cost of manufacture and assembly of the print head are substantially reduced.

In practice, the bottom-most print wire of each actuator assembly is fixedly secured to its associated magnetic armature by means of a swaging tool which extends down into the channel in the armature member. Spaced wedge-shaped working surfaces on this tool displace the walls of the armature channel on either side of the bottom print wire and behind the terminal end of the wire to securely lock the print wire in position.

In addition to providing a print head assembly requiring a minimal number of individual parts, the print head arrangement of the invention is compact and efficient. The only housing required is formed by two parallel-spaced side plates which lock the principal print head components in position. This not only simplifies assembly, but eliminates complicated housing constructions required with other print head designs. Since the solenoid coils 56*a–56g* are arranged one behind the other, the print head requires minimal width. Since the print wires operate in a straight line and strike the paper perpendicularly, high quality impressions are obtained and no possibility exists that movement of the wires will be hindered by guide tubes or the like. Furthermore, the construction provides minimal sliding friction between the print wires and the guide elements, and the low mass magnetic plunger possible for each print wire minimizes inertial effects during high speed operation.

Connections between the individual solenoid windings 56*a–56g* and a multi-conductor cable 82 (FIG. 3) conveying signals to the print head are established by a single printed wiring board 83 suspended between frame members 41 and 42. The terminals 72 and 73 of the windings extend down to the circuit board, where they are electrically connected by conductive foil on the board to a multi-pin connector 84. A mating multi-pin connector 85 at the end of cable 82 completes the connection to the individual conductors of cable 82. Circuit board 83 is held in position by means of tab portions 86 which extend into appropriately dimensioned recesses (FIG. 2) in side plates 41 and 42.

Thus, a compact, efficient and economical high speed print head has been shown which adapts itself to use in high speed printers wherein reliability, performance and economy are important factors. While the invention has been shown in conjunction with a print head having seven print wires arranged in a vertical plane, it will be appreciated that the invention can be practiced with other numbers and arrangements of print wires.

While a particular embodiment of the invention has been shown and described, it will be obvious to those skilled in the art that changes and modifications may be made therein without departing from the invention in its broader aspects, and therefore, the aim in the appended claims is to cover all such changes and modifications as fall within the true spirit and scope of the invention.

We claim:

1. A print head for printing on a print-receiving surface a matrix of dots within a predetermined character-forming array, comprising, in combination:

a housing;

a plurality of elongated, parallel-spaced print elements aligned with respective positions in said matrix, each of said print elements being slidably mounted in said housing and longitudinally displaceable to bring one end thereof into engagement with the print receiving surface;

restoration means for biasing said print elements to retract positions clear of the print-receiving surface;

a plurality of identical substantially flat one-piece magnetically conductive end plates arranged generally perpendicular to said print elements in parallel-spaced relationship substantially one behind the other, each of said end plates including an aperture for receiving at least a portion of said print elements therethrough;

actuator means including a plurality of solenoid windings disposed between respective adjacent pairs of said end plates for selectively producing a magnetic field between said adjacent pairs of end plates;

means including a plurality of magnetic armatures mechanically coupled to respective ones of said print elements between respective pairs of said end plates and responsive to the magnetic field therebetween for displacing respective ones of said print elements into engagement with the print-receiving surface; and a plurality of non-magnetically-conductive bobbins disposed between said adjacent pairs of said end plates, each of said bobbins including a core portion for receiving said solenoid winding, and an axially extending aperture therethrough for receiving at least a portion of the associated one of said magnetic armatures therein.

2. A print head as defined in claim 1 wherein said end plates each include indexing means on one side thereof for engaging the adjacent one of said bobbins, and wherein said adjacent end plate and bobbin cooperatively receive said solenoid winding in supporting engagement.

3. A print head as defined in claim 1 wherein said restoration means comprise a plurality of flat spring elements disposed between said adjacent pairs of said end plates, said spring elements each being mounted at opposite ends thereof to respective ones of said bobbins and each including a central aperture for engaging a respective one of said magnetic armatures.

4. A print head as defined in claim 1 wherein said end plates each include integral outwardly-projecting mounting ears, and wherein said housing comprises a pair of parallel-spaced side plate members each having a plurality of mounting slots adapted to receive said mounting ears for positioning said end plates substantially one behind the other with said print element-receiving apertures therein in substantial alignment with said parallel-spaced print elements.

5. A print head as defined in claim 1 wherein said bobbins each include outwardly projecting mounting ears and wherein said side plates of said housing each include apertures for engaging said mounting ears to maintain said bobbins in position.

6. A print head as defined in claim 1 wherein said print elements are arranged in a plane generally perpendicular to said end plates, and said magnetic armatures are each generally cylindrical in form and include a radially-aligned axially-extending channel therethrough for receiving at least a portion of said print elements.

7. A print head as defined in claim 6 wherein said print elements extend from said print receiving surface to the associated one of said magnetic armatures, and said magnetic armatures are fixedly attached to the respective one of said print members received within said axially-extending channel adjacent the bottom thereof.

8. A print head as defined in claim 1 wherein said magnetic armatures and bobbins are identical in construction, and said print elements are arranged in a vertical plane, and wherein each of said print elements extends only from its respective impact location in said array to its respective armature, and wherein said end plates and said bobbins are progressively displaced in said vertical plane from one end of said print head whereby each of said print elements is received in an identical location on its respective armature.

9. A print head for printing on a print-receiving surface a matrix of dots within a predetermined character-forming array, comprising, in combination:

a housing;

a plurality of elongated parallel-spaced print elements aligned with respective positions in said matrix in a vertical plane, each of said print elements being slidably mounted in said housing and longitudinally displacable to bring one end thereof into engagement with the print-receiving surface;

restoration means for biasing said print elements to retract positions clear of the print-receiving surface;

a plurality of identical one-piece magnetically conductive end plates arranged generally perpendicular to said print elements in parallel-spaced relationship substantially one behind the other, each of said end plates including an aperture for receiving at least a portion of said print elements therethrough;

actuator means including a plurality of solenoid windings disposed between respective adjacent pairs of said end plates for selectively producing a magnetic field between said adjacent pairs of end plates; and means including a plurality of identical one-piece magnetic armatures mechanically coupled to the opposite ends of respective ones of said print elements between respective pairs of said end plates and responsive to the magnetic field therebetween for displacing respective ones of said print elements into engagement with the print-receiving surface; said armatures each including a recess for engaging one of said print elements, said end plates and armatures being progressively displaced in said vertical plane from one end of said print head whereby said print elements engage said respective ones of said armatures in said recesses.

10. A print head as defined in claim 9 wherein said actuator means include a plurality of identical nonmagnetically conductive bobbins disposed between said adjacent pairs of said end plates, each of said bobbins including a core portion for receiving said solenoid winding, and an axially extending aperture therethrough for receiving at least a portion of the associated one of said magnetic armatures therein, said core portion and said aperture being aligned with the associated one of said print elements.

11. A print head as defined in claim 10 wherein said end plates each include indexing means on one side thereof for engaging the adjacent one of said bobbins, and wherein said adjacent end plate and bobbin cooperatively receive said solenoid winding in supporting engagement.

12. A print head as defined in claim 10 wherein said restoration means comprise a plurality of identical flat spring elements disposed between said adjacent pairs of said end plates, said spring elements each being mounted at opposite ends thereof to respective ones of said bobbins and each including a central aperture for engaging a respective one of said magnetic armatures.

13. A print head as defined in claim 9 wherein said end plates each include integral outwardly-projecting mounting ears, and wherein said housing comprises a pair of parallel-spaced side plate members each having a plurality of mounting slots adapted to receive said mounting ears for positioning said end plates, with said apertures therein in substantial axial alignment with respective ones of said parallel-spaced print elements.

14. A print head as defined in claim 10 wherein said bobbins each include outwardly projecting mounting ears and wherein said side plates of said housing each include apertures for engaging said mounting ears to maintain said bobbins in position with said core portions thereof in substantial axial alignment with respective ones of said print elements.

15. A print head as defined in claim 9 wherein said magnetic armatures are each generally cylindrical in form and include a radially-aligned axially-extending channel therethrough for receiving at least a portion of said print elements.

16. A print head as defined in claim 15 wherein said magnetic armatures are fixedly attached to the respective one of said print members received within said axially-extending channel adjacent the bottom thereof.

17. A print head as defined in claim 9 wherein said print elements each comprise straight cylindrical wire segments.

18. A print head for printing on a print-receiving surface a matrix of dots within a predetermined character-forming array, comprising, in combination:

a plurality of parallel-spaced print elements aligned with respective positions in said matrix, one end of each of said print elements being positioned adjacent the print-receiving surface;

restoration means for biasing said print elements to retract positions clear of the print-receiving surface;

a plurality of identical magnetically conductive end plates arranged in parallel-spaced relationship substantially one behind the other, each of said plates including an aperture for receiving at least a portion of said print elements therethrough and a pair of mounting tabs projecting from opposite sides thereof;

actuator means including a plurality of solenoid windings disposed between respective adjacent pairs of said end plates for selectively producing a magnetic field between selected ones of said adjacnet pairs of end plates;

said actuator means further including a plurality of bobbins disposed between said adjacent pairs of end plates, each of said bobbins including a core portion for receiving said winding, a pair of mounting ears projecting from opposite sides thereof, and an axially extending aperture for receiving at least a portion of said print elements;

means including a plurality of magnetic armatures machanically coupled to respective ones of said print elements between respective pairs of said end plates and responsive to the magnetic field therebetween for driving said print elements into impact with the print-receiving surface upon actuation of the respective one of said solenoid windings; and housing means comprising a pair of parallel-spaced side plate members each having mounting slots adapted to receive said mounting ears for positioning said end plates substantially one behind the other with said apertures therein in substantial alignment within said parallel-spaced elements; and for positioning said bobbins with said core portions thereof in substantial axial alignment with respective ones of said print elements.

19. A print head for printing on a print-receiving surface a matrix of dots within a predetermined character-forming array, comprising, in combination:

a housing;

a plurality of elongated parallel-spaced print elements alinged with respective positions in said matrix, each of said print elements being slidably mounted in said housing and longitudinally displacable to bring one end thereof into engagement with the print receiving surface;

a plurality of identical one-piece magnetically-conductive end plates arranged generally perpendicular to said print elements in parallel-spaced relationship substantially one behind the other, each of said end plates including an aperture for receiving at least a portion of said print elements therethrough;

actuator means including a plurality of solenoid windings disposed between respective adjacent pairs of said end plates for selectively producing a magnetic field between said adjacent pairs of end plates;

means including a plurality of magnetic armatures mechanically coupled to respective ones of said print elements between respective pairs of said end plates and responsive to the magnetic field therebetween for displacing respective ones of said print elements into engagement with the print-receiving surface;

means including a plurality of identical nonmagnetically-conductive bobbins disposed between said adjacent pairs of end plates, each of said bobbins including a core portion for receiving said solenoid winding, and an axially extending aperture therethrough for receiving at least a portion of the associated one of said magnetic armatures; and restoration means including a plurality of flat spring elements disposed between said adjacent pairs of said end plates, said spring elements each being mounted at opposite ends thereof to respective ones of said bobbins and each including a central aperture for engaging a respective one of said magnetic armatures to bias said print elements to retract positions clear of the print receiving surface.

20. A print head as defined in claim 19 wherein said end plates and said bobbins each include integral outwardly-projecting mounting ears, and wherein said housing comprises a pair of parallel-spaced side plate members each having a plurality of mounting slots adapted to receive said mounting ears for positioning said end plates and said bobbins substantially one behind the other with said apertures therein aligned to receive at least a portion of said print elements.

21. A print head for printing on a print-receiving surface a matrix of dots within a predetermined character-forming array, comprising, in combination:

a housing; P1 a plurality of elongated parallel-spaced print elements aligned with respective positions in said matrix, in a vertical plane, each of said print elements being slidably mounted in said housing and longitudinally displaceable to bring one end thereof into engagement with the print-receiving surface;

a plurality of identical one-piece magnetically conductive end plates arranged generally perpendicular to said print elements in parallel-spaced relationship substantially one behind the other, each of said end plates including an aperture for receiving at least a portion of said print elements therethrough;

actuator means including a plurality of solenoid windings disposed between respective adjacent pairs of said end plates for selectively producing a magnetic field between said adjacent pairs of end plates;

means including a plurality of identical one-piece magnetic armatures mechanically coupled to the opposite ends of said print elements between respective pairs of said end plates and responsive to the magnetic field therebetween for displacing respective ones of said print elements into engagement with the print-receiving surface, said armatures each including an engaging recess for engaging the associated one of said print elements, means including a plurality of identical non-magnetically-conductive bobbins disposed between said adjacent pairs of said end plates, each of said bobbins including a core portion for receiving said solenoid winding, and an axially extending aperture therethrough for receiving at least a portion of the associated one of said magnetic armatures therein, said core portions and said apertures being aligned with the associated one of said print elements;

restoration means comprising a plurality of flat spring elements disposed between said adjacent pairs of said end plates, said spring elements each being mounted at opposite ends thereof to respective ones of said bobbins and each including a central aperture for engaging a respective one of said magnetic armatures; and said end plates, and armatures being progressively displaced in said vertical plane from one end of said print head whereby said print elements engage respective ones of said armatures of said engaging access.

22. A print head as defined in claim 21 wherein said end plates and said bobbins each include integral outwardly-projecting mounting ears, and wherein said housing comprises a pair of parallel-spaced side plate members each having a plurality of mounting slots adapted to receive said mounting ears for positioning said end plates and said bobbins.

23. A print head for printing on a print-receiving surface a matrix of dots within a predetermined character-forming array, comprising, in combination:

a housing;

a plurality of elongated, parallel-spaced print elements aligned with respective positions in said matrix, each of said print elements being slidably mounted in said housing and longitudinally displaceable to bring one end thereof into engagement with the print receiving surface;

a plurality of one-piece magnetically conductive end plates arranged generally perpendicular to said print elements in parallel-spaced relationship substantially one behind the other, each of said end plates including an aperture for receiving at least a portion of said print elements therethrough;

actuator means including a plurality of solenoid windings disposed between respective adjacent pairs of said end plates for selectively producing a magnetic field between said adjacent pairs of end plates;

means including a plurality of magnetic armatures mechanically coupled to respective ones of said print elements between respective pairs of said end plates and responsive to the magnetic field therebetween for displacing respective ones of said print elements into engagement with the print-receiving surface;

a plurality of non-magnetically-conductive bobbins disposed between said adjacent pairs of said end plates, each of said bobbins including a core portion for receiving said solenoid winding, and an axially extending aperture therethrough for receiving at least a portion of the associated one of said magnetic armatures therein;

restoration means comprising a plurality of flat spring elements disposed between said adjacent pairs of said end plates, said spring elements each being mounted at opposite ends thereof to respective ones of said bobbins and each including a central aperture for engaging a respective one of said magnetic armatures.

24. A print head for printing on a print-receiving surface a matrix of dots within a predetermined character-forming array, comprising, in combination:

a housing;

a plurality of elongated, parallel-spaced print elements aligned with respective positions in said matrix, each of said print elements being slidably mounted in said housing and longitudinally displaceable to bring one end thereof into engagement with the print receiving surface;

restoration means for biasing said print elements to retract positions clear of the print-receiving surface;

a plurality of one-piece magnetically conductive end plates arranged generally perpendicular to said print elements in parallel-spaced relationship substantially one behind the other, each of said end plates including an aperture for receiving at least a portion of said print elements therethrough;

actuator means including a plurality of solenoid windings disposed between respective adjacent pairs of said end plates for selectively producing a magnetic field between said adjacent pairs of end plates;

means including a plurality of magnetic armatures mechanically coupled to respective ones of said print elements between respective pairs of said end plates and responsive to the magnetic field therebetween for displacing respective ones of said print elements into engagement with the print-receiving surface;

a plurality of non-magnetically-conductive bobbins disposed between said adjacent pairs of said end plates, each of said bobbins including a core portion for receiving said solenoid winding, and an axially extending aperture therethrough for receiving at least a portion of the associated one of said magnetic armatures therein; and said end plates and said bobbins each including integral outwardly-projecting mounting ears, and said housing comprising a pair of parallel-spaced side plate members each having a plurality of mounting slots adapted to receive said mounting ears for positioning said end plates and said bobbins substantially one behind the other with said print element-receiving apertures therein in substantial alignment with said parallel-spaced print elements.

25. A print head for printing on a print-receiving surface a matrix of dots within a predetermined character-forming array, comprising, in combination:

a housing;

a plurality of elongated, parallel-spaced print elements aligned with respective positions in said matrix, each of said print elements being slidably mounted in said housing and longitudinally displaceable to bring one end thereof into engagement with the print receiving surface;

restoration means for biasing said print elements to retract positions clear of the print-receiving surface;

a plurality of one-piece magnetically conductive end plates arranged generally perpendicular to said print elements in parallel-spaced relationship substantially one behind the other, each of said end plates including an aperture for receiving at least a portion of said print elements therethrough;

actuator means including a plurality of solenoid windings disposed between respective adjacent pairs of said end plates for selectively producing a magnetic field between said adjacent pairs of end plates;

means including a plurality of magnetic armatures mechanically coupled to respective ones of said print elements between respective pairs of said end plates and responsive to the magnetic field therebetween for displacing respective ones of said print elements into engagement with the print-receiving surface;

said end plates, magnetic armatures, bobbins, solenoid windings, and spring members being identical in construction; and said print elements being arranged in a vertical plane and each extending only from its respective impact location in said array to its respective armature, and wherein said end plates and said bobbins are progressively displaced in said vertical plane from one end of said print head whereby each of said print elements is received in an identical location on its respective armature.

* * * * *

UNITED STATES PATENT AND TRADEMARK OFFICE

CERTIFICATE OF CORRECTION

PATENT NO. : 4,300,845

DATED : November 17, 1981

INVENTOR(S) : Donald P. Martin et al

It is certified that error appears in the above-identified patent and that said Letters Patent are hereby corrected as shown below:

Col. 4, Line 23: "3" should be --13--.

Col. 5, Line 27: Change "solts" to --slots--.
Line 29: Change "engaged" to --engage--.

Col. 12, Line 57: Delete "Pl", and begin new paragraph with --a plurality--.

Signed and Sealed this

*Twenty-fifth* Day of *May 1982*

[SEAL]

*Attest:*

GERALD J. MOSSINGHOFF

*Attesting Officer*

*Commissioner of Patents and Trademarks*